US006196959B1

(12) United States Patent
Jörg et al.

(10) Patent No.: US 6,196,959 B1
(45) Date of Patent: Mar. 6, 2001

(54) METHOD AND DEVICE FOR FOLDING SHEET PILES

(75) Inventors: Helmut Jörg, Neusass; Walter Okelmann, Augsburg, both of (DE)

(73) Assignee: Böwe Systec AG, Augsburg (DE)

( * ) Notice: Subject to any disclaimer, the term of this patent is extended or adjusted under 35 U.S.C. 154(b) by 0 days.

(21) Appl. No.: 09/242,545

(22) PCT Filed: Feb. 11, 1998

(86) PCT No.: PCT/EP98/00771

§ 371 Date: Feb. 18, 1999

§ 102(e) Date: Feb. 18, 1999

(87) PCT Pub. No.: WO98/37005

PCT Pub. Date: Aug. 27, 1998

(30) Foreign Application Priority Data

Feb. 19, 1997 (DE) ..... 197 06 517

(51) Int. Cl.[7] ..... B31B 1/00

(52) U.S. Cl. ..... 493/23; 493/29; 493/33; 493/36; 493/416

(58) Field of Search ..... 493/23, 24, 25, 493/26, 33, 36, 360, 32, 29, 416, 449, 444, 458

(56) References Cited

U.S. PATENT DOCUMENTS

| | | | | |
|---|---|---|---|---|
| 4,777,729 | * | 10/1988 | Hausler | 271/263 |
| 5,026,035 | * | 6/1991 | Martinez et al. | 493/25 |
| 5,174,562 | * | 12/1992 | Mizunaga et al. | 271/261 |
| 5,358,464 | * | 10/1994 | Funk et al. | 493/23 |
| 5,556,360 | * | 9/1996 | Kober et al. | 493/23 |

FOREIGN PATENT DOCUMENTS

| | | |
|---|---|---|
| 3120526 | 6/1982 | (DE) . |
| 3934623 A1 | 4/1991 | (DE) . |
| 4446206 A1 | 6/1996 | (DE) . |
| 0748756 | 12/1996 | (EP) . |

* cited by examiner

*Primary Examiner*—Stephen F. Gerrity
*Assistant Examiner*—Sam Tawfik
(74) *Attorney, Agent, or Firm*—Dougherty & Clements LLP

(57) ABSTRACT

In the case of a method of folding stacks of sheets, which can consist of one or of a plurality of sheets that may have different folding resistances, by supplying a plurality of stacks of sheets to a folding device by means of a temporally successive, cyclic supply which comprises phases of movement and pauses in movement, a stack folding resistance for a respective stack of sheets is first determined on the basis of at least the number and/or the folding resistance of the individual sheets forming a stack of sheets. Following this, the respective stack of sheets is folded, the folding speed used by the folding device for folding said stack of sheets being controlled in dependence upon the stack folding resistance that has been determined for this stack of sheets, the control of the folding speed of the folding device being carried out during respective pauses in movement of the cyclic supply. In the case of a reduction of the folding speed, the pause in movement is extended for the folding of the next stack of sheets to be folded, if the necessary folding-speed reduction is not achieved during the normal pause in movement of the cyclic supply. And in the case of an increase in the folding speed, the pause in movement is, depending on the time required, either extended for the folding of the next stack of sheets to be folded, if the necessary increase in the folding speed is not achieved during the normal pause in movement of the cyclic supply, or not extended for the folding of the next stack of sheets to be folded, although the necessary increase in the folding speed is not achieved during the normal pause in movement.

15 Claims, No Drawings

METHOD AND DEVICE FOR FOLDING SHEET PILES

FIELD OF THE INVENTION

The present invention refers to methods and an apparatuses for folding stacks of sheets making use of folding devices of the type used e.g. in a paper handling device.

BACKGROUND ART

Paper handling devices are primarily used by large enterprises, banks, insurance companies, service-rendering enterprises, etc. In these enterprises, the paper handling devices serve to process large amounts of paper, such as in voices, reminders, statements of account, insurance policies, or cheques. For obtaining at the end of the paper handling device an appropriate combination of various necessary papers, it is necessary that, after having been printed, the various papers are correctly processed by the paper handling device. This processing takes place at successive stations of the paper handling device and comprises e.g. separating, sorting, collecting, folding and stapling of the various papers as well as subsequent enveloping of the assorted material, and stamping of the finished letter so that letters ready for dispatch are discharged at the output of the paper handling device.

The present invention refers to methods and apparatuses for folding stacks of sheets, which are adapted to be used e.g. in paper handling devices of the kind described hereinbefore. In such paper handling devices, stacks of sheets, which may comprise different numbers of sheets, are combined for the respective letters. The expression stack of sheets as used in the present context is intended to comprise an individual sheet as well as a plurality of sheets.

Depending on the fibre orientation, the kind of fibres, the basis weight, the thickness etc., a sheet of paper has a varying ease of folding, i.e. a varying folding resistance. The folding resistance of a stack of sheets is therefore defined by the ease of folding of the individual sheets forming the stack of sheets and by the number of sheets forming said stack of sheets. This folding resistance of a stack of sheets means that the folding speed used can only be a speed that is adapted to one of the above-mentioned characteristic values, viz. fibre orientation, kind of fibres, basis weight, thickness as well as the number of sheets folded at a time.

If pieces of paper which differ with regard to their ease of folding, i.e. with regard to their folding resistance, are to be processed in known devices, the folding speed must be chosen such that also the material having the least ease of folding, i.e. the highest folding resistance, can still be processed. This means that the device must always be operated at the lowest necessary speed; this will, of course, result in performance losses within the respective cycle. Modern folding mechanisms are therefore often equipped with a mechanical or an electrical adjustment mechanism with the aid of which the speed is adjusted by the operator of a device prior to a job. The expression job refers here to a production cycle in which a plurality of stacks of sheets, which may differ with regard to their ease of folding, are folded.

If, however, varying numbers of sheets are collected prior to the folding operation in a job in which paper with identical characteristic values is processed, it will be necessary to adjust also in the case of the above-mentioned operator adjustment for a job the lowest necessary speed for the whole job, and this will again result in losses within the respective cycle.

DESCRIPTION OF PRIOR ART

DE 4446206 A1 describes an apparatus for preparing consignments or the like, which consist of different numbers of pages, for enveloping. The known apparatus is provided with a device for successively transporting individual pages of the consignments to be prepared and with means for separating the pages of a respective consignment to be prepared from the pages of the subsequent consignment and for combining the respective pages associated with a consignment to be prepared. The apparatus is additionally equipped with a limit value counter used for counting the pages of the respective consignment to be prepared. As long as the number of pages counted by the limit value counter for one consignment is below a limit value, the consignment will be folded by means of a folding unit arranged in the transport path of the consignments. If the number of pages for a consignment which has been registered by the limit value counter is, however, equal to or larger than the limit value, the consignment will not be folded, but it will be advanced without having been folded. The apparatus described in DE 4446206 A1, does, however, not provide a solution for the above-described problem, since, for a job to be executed, it is still necessary to adjust the folding speed to the maximum stack height that still has to be processed. Furthermore, consignments whose number of sheets exceeds a predetermined limit value are not folded at all.

DE 39 34 623 A1 discloses a device for determining the folding force of single-layer or multi-layer paper samples of different thicknesses to be folded, said device being adapted to be used for measuring the paper height and the compressibility during folding.

DE 31 20 526 A1 discloses a folding device where the belt speed of a feed belt and the cycle rate of the folding machine are determined by a computing unit in dependence upon parameters of the paper, such as format length, format width, paper properties, weighting factors etc. The parameters are inputted in a computer via an input means, and the computer outputs e.g. the belt speed and the cycle rate, which are converted into analog control variables.

SUMMARY OF THE INVENTION

It is an object of the present invention to provide a method of folding a plurality of temporally successive stacks of sheets, which permits an optimized control of the folding speed of the folding device.

In accordance with a first aspect of the present invention, this object is achieved by a method of folding stacks of sheets, which can consist of one or of a plurality of sheets that may have different folding resistances, by supplying a plurality of stacks of sheets to a folding device by means of a temporally successive, cyclic supply which comprises phases of movement and pauses in movement, said method comprising the following steps: determining a stack folding resistance for a respective stack of sheets on the basis of at least the number and/or the folding resistance of the individual sheets forming a stack of sheets; and folding a respective stack of sheets, the folding speed used by the folding device for folding said stack of sheets being controlled in dependence upon the stack folding resistance that has been determined for this stack of sheets, the control of the folding speed of the folding device being carried out during respective pauses in movement of the cyclic supply in such a way that, in the case of a reduction of the folding speed for the folding of the next stack of sheets to be folded, the pause in movement is extended, if the necessary folding-speed reduction is not achieved during the normal pause in movement of the cyclic supply; that, in the case of an increase in the folding speed for the folding of the next stack of sheets to be folded, the pause in movement is, depending on the time required, either extended, if the necessary increase in the folding speed is not achieved during the normal pause in movement of the cyclic supply, or not extended, although the necessary increase in the folding speed is not achieved during the normal pause in movement.

Thus, the present invention provides a method of folding stacks of sheets, which can consist of one or of a plurality of sheets that may have different folding resistances, by supplying a plurality of stacks of sheets to a folding device by means of a temporally successive, cyclic supply which comprises phases of movement and pauses in movement, said method comprising the steps of first determining a stack folding resistance for a respective stack of sheets on the basis of at least the number and/or the folding resistance of the individual sheets forming a stack of sheets, and then folding a respective stack of sheets, the folding speed used by the folding device for folding said stack of sheets being controlled in dependence upon the stack folding resistance that has been determined for this stack of sheets, the control of the folding speed of the folding device being carried out during respective pauses in movement of the cyclic supply in such a way that, in the case of a reduction of the folding speed for the folding of the next stack of sheets to be folded, the pause in movement is extended, if the necessary folding-speed reduction is not achieved during the normal pause in movement of the cyclic supply, and that, in the case of an increase in the folding speed for the folding of the next stack of sheets to be folded, the pause in movement is, depending on the time required, either extended, if the necessary increase in the folding speed is not achieved during the normal pause in movement of the cyclic supply, or not extended, although the necessary increase in the folding speed is not achieved during the normal pause in movement.

In contrast to the prior art, where stacks within a job are folded at the speed required for the stack having the highest folding resistance or with a power required for such a stack, the present invention provides a variable adjustment of the folding speed on the basis of the respective stack folding resistances of the individual stacks of sheets. This permits e.g. the realization of devices with drives having smaller dimensions, since the folding speed of the device can be reduced automatically for the folding of stacks having a higher folding resistance, e.g. stacks having a larger thickness. It follows that the method and the apparatus according to the present invention permit the realization of folding devices with drives having smaller dimensions. Alternatively, they permit a higher throughput when drives having the same dimensions are used.

In accordance with a second aspect of the present invention, this object is achieved by an apparatus for folding stacks of sheets, which can consist of one or of a plurality of sheets that may have different folding resistances, comprising: a folding device having a controllable folding speed; a supplier adapted for effecting a temporally successive, cyclic supply of a plurality of stacks of sheets to said folding device, said cyclic supply comprising phases of movement and pauses in movement; a folding resistance determining device adapted for determining a stack folding resistance of the stacks of sheets supplied to the folding device, and a controller adapted for controlling, between the folding of two stacks, the folding speed of the folding device in dependence upon the respectively determined stack folding resistance of a stack of sheets for the folding of this stack of sheets, in such a way that, in the case of a reduction of the folding speed for the folding of the next stack of sheets to be folded, the pause in movement is extended, if the necessary folding-speed reduction is not achieved during the normal pause in movement of the cyclic supply; that, in the case of an increase in the folding speed for the folding of the next stack of sheets to be folded, the pause in movement is, depending on the time required, either extended, if the necessary increase in the folding speed is not achieved during the normal pause in movement of the cyclic supply, or not extended, although the necessary increase in the folding speed is not achieved during the normal pause in movement.

Therefore, the present invention additionally provides an apparatus for folding stacks of sheets, which can consist of one or of a plurality of sheets that may have different folding resistances, said apparatus comprising a folding device operating at a controllable folding speed, a means for effecting a temporally successive, cyclic supply of a plurality of stacks of sheets to said folding device, said cyclic supply comprising phases of movement and pauses in movement, a means for determining a stack folding resistance of the stacks of sheets supplied to the folding device, and a means for controlling, between the folding of two stacks, the folding speed of the folding device in dependence upon the respectively determined stack folding resistance of a stack of sheets for the folding of this stack of sheets, in such a way that, in the case of a reduction of the folding speed for the folding of the next stack of sheets to be folded, the pause in movement is extended, if the necessary folding-speed reduction is not achieved during the normal pause in movement of the cyclic supply, and that, in the case of an increase in the folding speed for the folding of the next stack of sheets to be folded, the pause in movement is, depending on the time required, either extended, if the necessary increase in the folding speed is not achieved during the normal pause in movement of the cyclic supply, or not extended, although the necessary increase in the folding speed is not achieved during the normal pause in movement.

The means for effecting a temporally successive supply of a plurality of stacks of sheets to the folding device can be e.g. the transport and gathering path of a paper handling device. In this case, the folding device is a processing station of the paper handling device.

According to preferred embodiments of the present invention, an optimum folding speed of the folding device for a respective stack of sheets is determined by means of comparison tables on the basis of the stack folding resistance of said stack of sheets. Subsequently, the folding speed of the folding device is controlled such that it corresponds to this optimum folding speed.

The present invention provides speed optimization during the folding of stacks of sheets having different folding resistances with due regard to the boundary conditions, i.e. that the moment of inertia of the driven components of the folding mechanism cannot be reduced to an arbitrary extent for reasons of strength and that the dynamic of the drive device cannot be increased to an arbitrary extent for technical reasons as well as for reasons of costs.

The present invention can be realized with arbitrary known folding devices. The folding mechanism is preferably equipped with folding rolls provided with a polyurethane foam coating (Vulkozell coating) which is applied e.g. to a steel core. This permits the moment of inertia of the folding mechanism to be reduced to approx. 15% in comparison with conventional steel rolls. Hence, a very high dynamic can be achieved by known three-phase motors, which have already been used in folding mechanisms up to now and which are operated via commercially available frequency converters.

DESCRIPTION OF THE PREFERRED EMBODIMENTS

In the following, preferred embodiments of the present invention will be explained with reference to a folding device, which is a component part of a paper handling device, e.g. an enveloping device. It is, however, apparent that the present invention is also adapted to be applied to other processing devices where stacks of sheets with different folding resistances are folded.

In a paper handling device, stacks of paper are processed at different stations. Such a station of a paper handling device is e.g. a folding device. The different stations are interconnected by a transport means, the stacks being moved between the processing stations with the aid of said transport means. The present invention provides a method and an apparatus for automatically adapting the processing speed of the folding device in dependence upon the folding resistance of the individual stacks of sheets to be folded. The paper handling device can, for example, operate in cycles; in this mode of operation, phases of movement and pauses in movement follow one another cyclically. In such a paper handling device, stacks of sheets are formed by stacking sheets at collecting and transfer locations as well as supplement adding stations.

A control means of the paper handling device determines the stack folding resistance of the respective stacks of sheets fed to the folding mechanism. For determining the folding resistance, information with regard to the characteristic data of the sheet, e.g. the basis weight, is supplied via an input device to the control means e.g. for each sheet fed to the paper handling device. Prior to starting the processing of a job, characteristic data with regard to all the sheets fed to the paper handling device during this job can, in the same way, be inputted in the control means. The number of sheets of the respective stacks transported by the paper handling device can be determined by the control means on the basis of the information supplied to said control means for each sheet fed to the paper handling device. Alternatively, the number of sheets of a respective stack can be detected by optical detection means. Such detection with the aid of optical detection means can be used advantageously e.g. in cases where the sheets used during a job have the same characteristic data. In addition, the control means has knowledge of the kind of folding used, which is defined by the folding mechanism installed in the paper handling device. optionally, the kind of folding can be inputted prior to staring the processing of the respective job.

The control means determines on the basis of the characteristic data of the sheets, e.g. the basis weight, and on the basis of the numbers of sheets the ease of folding, i.e. the folding resistance, of a respective stack of sheets. Via the ease of folding and with due regard to the kind of folding used, the optimum speed of the folding mechanism is now found e.g. via comparison tables.

It is obvious that the control means can exclusively determine the ease of folding of the respective stacks of sheets on the basis of the number of sheets if sheets having identical characteristic data are used, and that it can exclusively determine said ease of folding on the basis of the characteristic data of the sheets if stacks comprising identical numbers of sheets are used.

The speed adaptation of the folding mechanism can only be carried out between two paper passages. As has already been described, the individual stacks of sheets are supplied to the folding mechanism with the aid of a transport means in temporal succession, e.g. in cycles. Control of the folding speed can only be effected between the folding of two stacks. If the supply does not take place in cycles, it may be necessary to control the transport speed of the transport means so as to guarantee that the folding speed of the folding device is controlled such that the folding speed for the next stack arriving at the device has been reached before said stack arrives at the folding device. Preferably, the stacks of sheets are, however, moved on the paper handling device cyclically, i.e. in cycles. In this case, the control of the folding speed of the folding device preferably takes place during the dead times, i.e. the pauses in movement, of the cyclic supply.

If this dead time is too short for carrying out the speed adaptation with the limited dynamic of the drive, it will be necessary to differentiate between a necessary increase in speed and reduction of speed of the folding drive. In the case of a necessary reduction of speed, the supply of the material must be delayed until the maximum speed for this material, which is, in turn, calculated on the basis of the optimum speed of the folding mechanism, has been reached. In the case of a necessary increase in speed, two cycle time calculations can be carried out according to one embodiment of the present invention. The first variant refers to the passage time with speed adaptation only during the dead time, whereas the second variant is directed to the passage time with a speed adaptation that is carried out until the optimum speed has been reached. In the case of this embodiment, control is carried out in accordance with the variant with the shorter passage time.

If the control means has early knowledge of the data of a plurality of successive stacks, it may be suitable to optimize the speed adaptation of the folding drive according to the present invention via all known data according to a preceding calculation. If the device following the folding mechanism in the paper handling device is not always ready to receive the material in question, it will also be advantageous to use necessary waiting times of the folding mechanism, which elapse until the device following the folding mechanism is ready to receive the material in question, for carrying out the speed adaptation for the next stack to be folded.

Hence, the present invention permits each individual material to be folded, e.g. an individual sheet or a stack comprising several sheets, to be folded with the maximum speed that is possible for the material in question. Performance losses within the respective cycle, which occur in the case of known methods, are avoided in this way. In addition, the present invention permits the use of drives having smaller dimensions, since the drive need not be dimensioned such that it suffices for the material having the highest folding resistance, since, if such a material is folded, the speed will be reduced automatically, whereupon the speed will be reincreased automatically, if the subsequent material to be folded is a material having a lower folding resistance.

What is claimed is:

1. A method of folding stacks of sheets, each stack comprising at least one sheet, wherein individual sheets may have different folding resistances, by supplying a plurality of stacks of sheets to a folding device by means of a temporally successive, cyclic supply which comprises phases of movement and pauses in movement, said method comprising the following steps:

determining a stack folding resistance for a respective stack of sheets based on at least one of a number and a folding resistance of individual sheets forming a stack of sheets; and folding a respective stack of sheets, a folding speed used by the folding device for folding said stack of sheets being controlled in dependence upon the stack folding resistance that has been determined for this stack of sheets, the control of the folding speed of the folding device being carried out during respective pauses in movement of the cyclic supply in such a way that, in case of a reduction of the folding speed for a folding of a next stack of sheets to be folded, a pause in movement is extended, if a necessary folding-speed reduction is not achieved during a normal pause in movement of the cyclic supply;

that, in case of an increase in the folding speed for a folding of a next stack of sheets to be folded, the pause in movement is extended or not extended, depending on a time required, if a necessary increase in the folding speed is not achieved during the normal pause in movement of the cyclic supply.

2. A method according to claim 1, wherein an optimum folding speed of the folding device for a respective stack of sheets is determined by means of comparison tables based on the stack folding resistance of said stack of sheets.

3. A method according to claim 1, wherein the stack folding resistance for a stack of sheets is determined by detecting a number of sheets of said stack of sheets and by making use of characteristic values of individual sheets of said stack of sheets.

4. A method according to claim 3, wherein the characteristic values of a sheet describe at least one of a fibre orientation, a kind of fibres, a basis weight and a thickness of said sheet.

5. A method according to claim 1, wherein the sheets supplied to the folding device each have an identical fixed folding resistance, said folding resistance of a respective stack of sheets being determined based on said fixed folding resistance and a number of sheets forming said stack.

6. A method according to claim 1, wherein the individual stacks of sheets are supplied to the folding device in temporal succession making use of a transport means.

7. A method according to claim 1, wherein a kind of folding used is taken into account in the control of the folding speed.

8. A method according to claim 1, wherein the folding device makes use of folding rolls which are implemented such that they have a reduced moment of inertia.

9. A method according to claim 8, wherein the folding device makes use of folding rolls which are provided with a polyurethane foam coating.

10. A method according to claim 8, wherein the folding device makes use of folding rolls which are hollow rolls.

11. An apparatus for folding stacks of sheets, each stack comprising at least one sheet wherein individual sheets may have different folding resistances, comprising:

a folding device having a controllable folding speed;

a supplier adapted for effecting a temporally successive, cyclic supply of a plurality of stacks of sheets to said folding device, said cyclic supply comprising phases of movement and pauses in movement;

a folding resistance determining device adapted for determining a stack folding resistance of the stacks of sheets supplied to the folding device, and a controller adapted for controlling, between the folding of two stacks, the folding speed of the folding device in dependence upon a respectively determined stack folding resistance of a stack of sheets for the folding of this stack of sheets, in such a way that, in case of a reduction of the folding speed for a folding of a next stack of sheets to be folded, a pause in movement is extended if a necessary folding-speed reduction is not achieved during a normal pause in movement of the cyclic supply;

that, in case of an increase in the folding speed for a folding of a next stack of sheets to be folded, the pause in movement is extended or not extended, depending on the time required, if a necessary increase in the folding speed is not achieved during the normal pause in movement of the cyclic supply.

12. An apparatus according to claim 11, wherein the means for determining the stack folding resistance determines said stack folding resistance based on at least one of a number of sheets of a respective stack and a folding resistance of individual sheets forming a respective stack of sheets.

13. An apparatus according to claim 12, wherein the folding device comprises folding rolls which are hollow rolls.

14. An apparatus according to claim 11, wherein the means for controlling the folding speed of the folding device determines making use of comparison tables an optimum folding speed of the folding device for a respective stack of sheets based on the stack folding resistance of said stack.

15. An apparatus according to claim 11, wherein the folding device comprises folding rolls which are provided with a polyurethane foam coating.

* * * * *